US009004081B2

(12) United States Patent
Hering et al.

(10) Patent No.: US 9,004,081 B2
(45) Date of Patent: Apr. 14, 2015

(54) HOUSEHOLD APPLIANCE, IN PARTICULAR A HOUSEHOLD DISHWASHING MACHINE

(75) Inventors: Reinhard Hering, Holzheim (DE); Michael Georg Rosenbauer, Reimlingen (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 573 days.

(21) Appl. No.: 13/498,334

(22) PCT Filed: Sep. 24, 2010

(86) PCT No.: PCT/EP2010/064105

§ 371 (c)(1), (2), (4) Date: Mar. 27, 2012

(87) PCT Pub. No.: WO2011/045164

PCT Pub. Date: Apr. 21, 2011

(65) Prior Publication Data

US 2012/0180817 A1 Jul. 19, 2012

(30) Foreign Application Priority Data

Oct. 12, 2009 (DE) ..... 10 2009 045 592

(51) Int. Cl.

| | |
|---|---|
| ***B08B 3/00*** | (2006.01) |
| ***D06F 39/00*** | (2006.01) |
| ***A47L 15/00*** | (2006.01) |
| ***A47L 15/46*** | (2006.01) |
| ***D06F 33/02*** | (2006.01) |
| *A47L 15/42* | (2006.01) |

(52) U.S. Cl.

CPC ..... *D06F 39/005* (2013.01); *A47L 15/0047* (2013.01); *A47L 15/4293* (2013.01); *A47L 15/46* (2013.01); *A47L 2401/20* (2013.01); *A47L 2401/26* (2013.01); *A47L 2501/26* (2013.01); *A47L 2501/32* (2013.01); *D06F 33/02* (2013.01); *D06F 2210/00* (2013.01); *D06F 2216/00* (2013.01)

(58) Field of Classification Search

None

See application file for complete search history.

(56) References Cited

U.S. PATENT DOCUMENTS

| | | | |
|---|---|---|---|
| 2005/0212652 | A1 | 9/2005 | Ludenia |
| 2010/0262315 | A1 | 10/2010 | Rosenbauer |

FOREIGN PATENT DOCUMENTS

| | | | |
|---|---|---|---|
| DE | 102006036551 | A1 | 2/2008 |
| DE | 102007058382 | A1 * | 6/2009 |
| EP | 1674797 | A2 | 6/2006 |

OTHER PUBLICATIONS

International Search Report PCT/EP2010/064105, mailed May 19, 2011.

* cited by examiner

*Primary Examiner* — Eric Golightly

(74) *Attorney, Agent, or Firm* — James E. Howard; Andre Pallapies

(57) ABSTRACT

A household appliance, in particular a household dishwasher, includes an external display, a transmission interface connected for signal transmission to the external display, and a power supply network for supply of electrical energy. The household appliance is isolated from the power supply network after completion of a treatment cycle, and the transmission interface is configured to transmit a signal to activate the external display to display at least the completion of the treatment cycle before the household appliance is isolated from the power supply network.

10 Claims, 2 Drawing Sheets

HOUSEHOLD APPLIANCE, IN PARTICULAR A HOUSEHOLD DISHWASHING MACHINE

BACKGROUND OF THE INVENTION

The invention relates to a household appliance, in particular a household dishwasher, at least having a transmission interface, which can be connected for signal transmission purposes to an external display means.

When consumer organizations rate household appliances, the energy consumption of the household appliance, in particular also its annual energy balance sheet, plays a significant role. Household appliances have an operating display with at least visual display means, for example LEDs, which can be used during the operation of the household appliance to display operating parameters, etc. and after completion of a treatment cycle according to a program to indicate that the treatment cycle has been completed. However after the end of the program the household appliance remains connected to the power supply network until the customer actively intervenes and deactivates the household appliance by actuating the main switch.

BRIEF SUMMARY OF THE INVENTION

The object of the invention is to provide a household appliance, in particular a household dishwasher, with which energy consumption is further reduced.

According to the invention provision is made for the household appliance to be isolated from a power supply network supplying said household appliance with electrical energy after completion of a treatment cycle and before the household appliance is isolated from the power supply network, in particular very close to the time of completion of the treatment cycle, for it to be possible for a signal to be transmitted by way of the transmission interface to activate the external display means to indicate at least the end of the treatment cycle. Corresponding switching means are provided here to isolate the household appliance from the power supply network, said switching means isolating the household appliance automatically, i.e. without intervention by a user, from the supply network, so that the household appliance is deactivated and in particular no further standby losses occur. Before the switching means brings about isolation from the supply network in response to completion of a treatment cycle, a controller of the household appliance for example generates a signal, which is to be transmitted by way of the transmission interface to activate an external display means. This can take place very close to the time of completion of the treatment cycle, for example before of even after completion of the treatment cycle. Thus after completion of the treatment cycle isolation from the power supply network can be delayed for example by a period of 1 second to 1 minute in order to generate the signal in this time interval and transmit it by way of the transmission interface. It can however also take place almost at the same time as completion of the treatment cycle or even within a time period of for example 1 second to 5 minutes before completion of the treatment cycle. In both instances energy consumption is reduced by the amount that would have been consumed in the abovementioned time period. It is also advantageous in this instance for an operator to be informed in a timely manner by the time lead-in of the completion of a treatment cycle, so that said operator can get to the household appliance, which may be in another room in an apartment or house for example, with the external display means being used in this instance to transmit information relating to the household appliance to different locations. The external display means can be for example a display on a cooker, a refrigerator and/or a radio. The signal connection between the transmission interface of the household appliance and the external display means can be established for example by radio, WLAN, Bluetooth, Powerline, etc. The external display means for displaying at least the end of the treatment cycle is activated by means of the transmission interface of the household appliance at the end of the treatment cycle. Since the end of the treatment cycle is displayed on the external display means according to the invention, the display of a completed treatment cycle directly on the household appliance is superfluous.

The invention is based on tests which have shown that the time period between completion of the actual treatment cycle and a following treatment cycle can be in the region of hours or days. If the main switch is not deactivated after the end of the treatment cycle, the visual display means in particular, which indicate the end of the program, then remain activated until the following treatment cycle. The energy consumption of the household appliance can thus be tangibly increased in the annual energy balance sheet.

The invention can be used in particular with a household appliance which is automatically taken out of operation after the end of the treatment cycle and in particular after activation of the external display means, to prevent energy consumption by the household appliance after the end of the treatment cycle.

With such total deactivation of the household appliance the user of said household appliance would not receive any information about whether the household appliance has completed the treatment cycle properly or whether there is a power failure or some other fault. According to the invention therefore the external display means is activated immediately before such deactivation of the household appliance, so that the end of the treatment cycle can be displayed on the external display means when the household appliance is isolated from the power supply network.

To reduce the energy consumption of the external display means, it can be deactivated during the treatment cycle or before it and only be reactivated when actuated correspondingly by the household appliance. In contrast the household appliance can have visual display means which only display operating states before and during the treatment cycle but not the end of the treatment cycle. The visual operating display can be deactivated correspondingly after the end of the treatment cycle.

The external display means can remain activated after the end of the treatment cycle for a predefined time period or until it is actuated by a trigger signal. The external display means can be deactivated automatically at the end of this time period.

Alternatively or additionally the controller of the household appliance can detect the opening of the appliance door for example. In such an instance the controller of the household appliance identifies that the user has been informed of the end of the treatment cycle. The controller can then generate a trigger signal, to deactivate the external display means by way of the transmission interface. When such a trigger signal is used to deactivate the external display means, the control device of the household appliance remains activated after the end of the program, while only the visual display means are deactivated.

The external display means can be activated and display the end of a program of the household appliance as follows: at the end of the treatment cycle a control device can generate a program end signal, which actuates the external display means by way of the transmission interface. As well as generating the program end signal, the control device can automatically generate a deactivation signal, with which at least the visual display means disposed in the control panel of the household appliance are automatically deactivated.

In one energy-saving embodiment the controller of the household appliance can have a self-holding contact circuit. The self-holding contact circuit can be deactivated by the deactivation signal and can open a switching element, which can be used to switch a power supply unit of the household appliance to power-free.

The self-holding contact circuit can have at least one on switch. This can be embodied as a push button, which is open in the unactuated state and closes electrical contact points when actuated. The push button can be actuated by an operator in the manner of a microswitch in the control panel of the household appliance and can be connected parallel to the abovementioned switching element.

The self-holding contact circuit can preferably have a bistable relay, to which a relay contact acting as a switching element can be connected. Such a bistable relay is primarily characterized by the attribute that in the power-free state it can adopt two different stable switching states. A relay contact of the bistable relay can also be connected as a switching element in the main supply line of the household appliance. When the deactivation signal is applied to the bistable relay, it switches the relay contact from a stable power-free open state to a stable power-free closed state or vice versa, with the result that the household appliance is decoupled completely from the network.

Provision is also preferably made for the on switch and off switch to be connected in a parallel manner. The power supply network can be in contact for example with an on switch configured as a microswitch and the switching element connected parallel to this. When the household appliance is out of operation, both the on switch and the switching element are open. Actuation by pressing of the microswitch allows the deactivated, i.e. open, switching element of the self-holding contact circuit to be bridged, with the result that a voltage pulse is applied to the control device. The voltage pulse is directed by way of the control device to the self-holding contact circuit, with the result that the self-holding contact circuit closes the switching element. This allows current from the network to flow by way of the now closed switching element to the self-holding contact circuit so that the switching element remains closed in a stable manner, while the on switch is opened again. As soon as the control device directs the deactivation signal to the self-holding contact circuit, said circuit opens the switching element, causing the power supply into the household appliance to be interrupted.

Provision is preferably made here for an equally high electrical voltage to be present at the on switch and the off switch. This allows a particularly simple structure.

Provision is preferably made here for the on switch and the off switch to be connected to the control device in such a manner that an activation and/or deactivation pulse is transmitted. Provision is preferably also made for the power supply unit to be disposed in such a manner that it forms a series circuit with the on switch and the off switch. Provision is also preferably made for the control device to be connected to the power supply unit in such a manner that it can be supplied with electrical energy. Provision is furthermore preferably made for the operating display to be connected to the power supply unit in such a manner that it can be provided with electrical energy. Finally provision is preferably made for the self-holding contact circuit to be assigned to a controller that can be actuated by the control device.

The self-holding contact circuit can preferably have a bistable relay, to which a relay contact acting as a switching element can be connected. Such a bistable relay is primarily characterized by the attribute that in the power-free state it can adopt two different stable switching states. A relay contact of the bistable relay can be connected as a switching element in the main supply line of the household appliance. When the deactivation signal is applied to the bistable relay, it switches the relay contact from a stable power-free open state to a stable power-free closed state or vice versa, with the result that the household appliance is decoupled completely from the network or connected to it. A flipflop, in particular an RS flipflop, can be used instead of a relay.

Finally provision is preferably made for the self-holding contact circuit to be connected to the off switch in such a manner that the off switch can be switched to an open state so that isolation from the supply voltage is possible in a simple manner.

The object of the invention is also achieved by a method as claimed in claim 8. Advantageous developments are set out in the subclaims.

BRIEF DESCRIPTION OF THE DRAWINGS

An exemplary embodiment of the invention is described in more detail below with reference to the accompanying figures, in which.

DETAILED DESCRIPTION OF EXEMPLARY EMBODIMENTS OF THE PRESENT INVENTION

Figure 1:
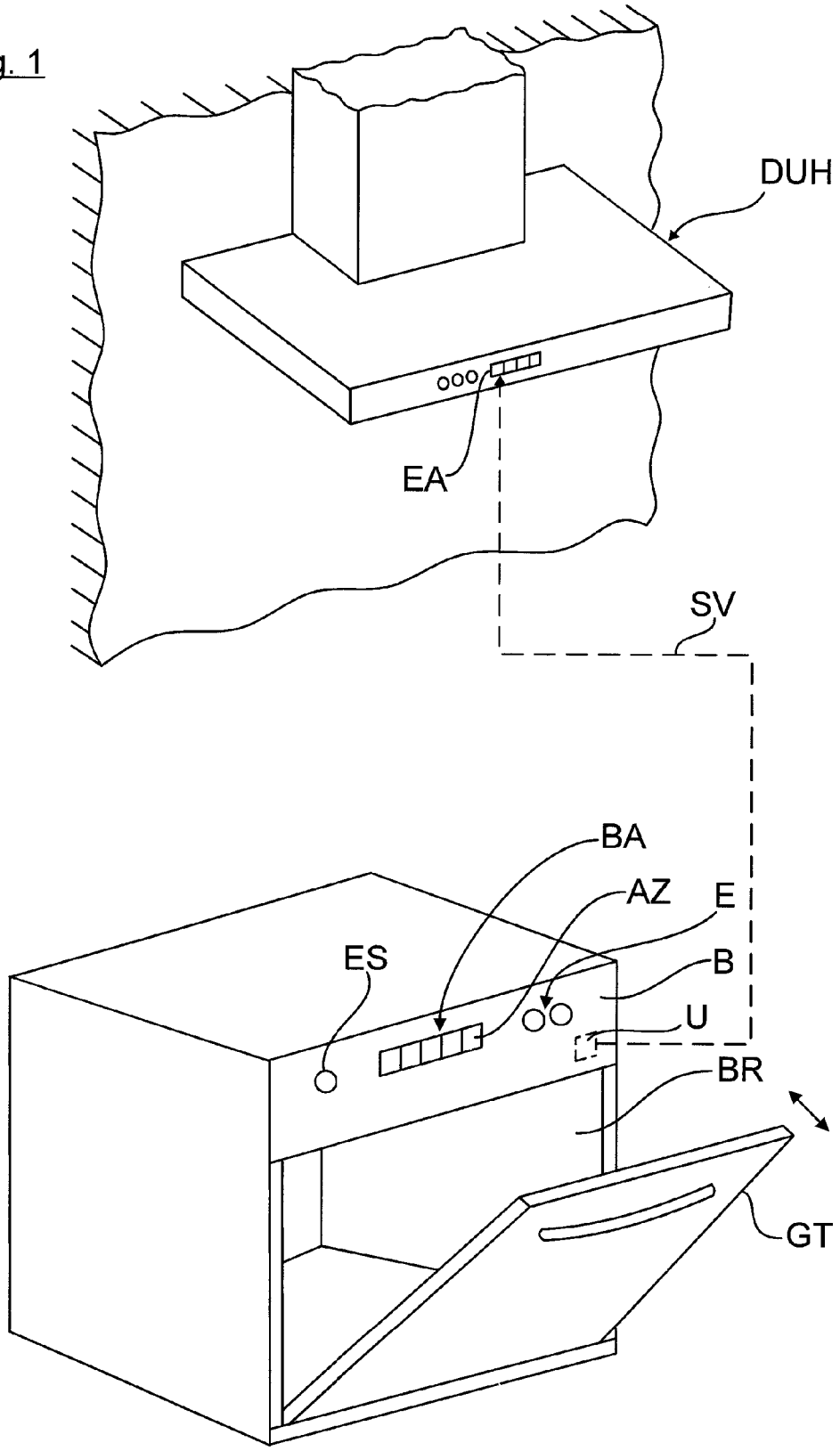
FIG. 1 shows a schematic perspective view of a household appliance network consisting of a household dishwasher and an extractor hood.

FIG. 1 shows a household appliance network, which in the present exemplary embodiment comprises a household dishwasher and an extractor hood DUH. The household dishwasher is fitted with a transmission interface U, which is connected for signal transmission purposes to a visual display means EA of the extractor hood DUH, as shown with the broken arrow SV. The display means EA of the extractor hood DUH can be for example a display with 7-segment displays as known per se. As described in more detail below, the display means AE of the extractor hood DUH can have the twin function of displaying operating parameters of the extractor hood and also the end of a program after a wash cycle of the household dishwasher.

The household dishwasher has a front appliance door GT, which can be pivoted in the known manner about a horizontal pivot axis at the bottom and with which a loading opening of the wash compartment BR can be opened for loading and/or unloading or closed. The loading opening is bounded at the top by a control panel B, which holds a microswitch ES and (simply indicated) visual display means AZ of an operating display BA. Input means E are also provided, which can be used to input operating parameters for a wash cycle of the household dishwasher.

The microswitch ES provided in the left region of the control panel B in FIG. 1 is configured here as a pushbutton switch for example. Actuation by pressing of the microswitch ES allows the household dishwasher to be switched to operation readiness, while subsequent actuation by pressing decouples the household dishwasher from the power supply network.

Figure 2:
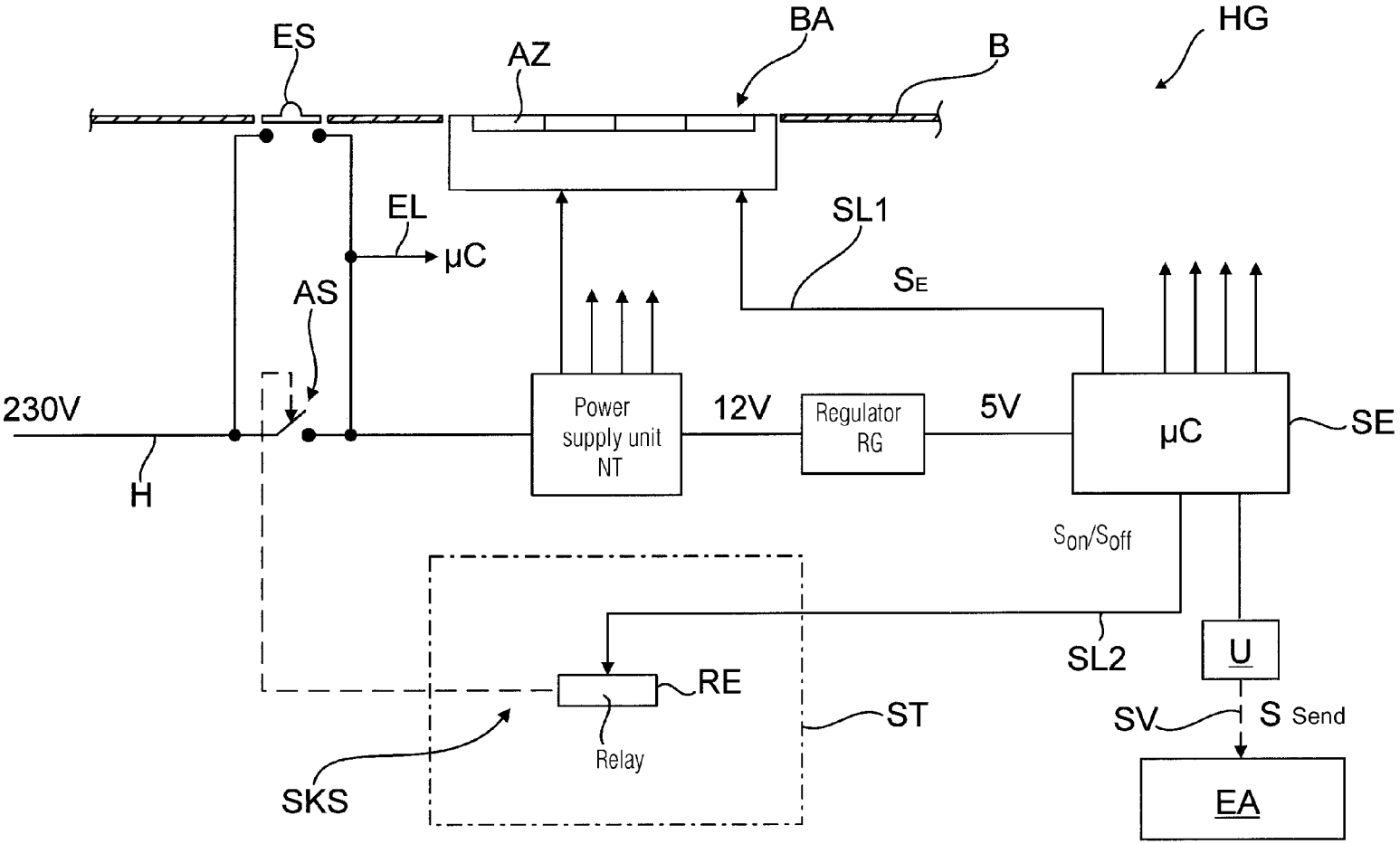
FIG. 2 shows a circuit arrangement of the household dishwasher.

FIG. 2 shows a circuit arrangement, in which the microswitch ES and the operating display BA by way of example are integrated. In the circuit arrangement shown the household dishwasher is connected by way of a main supply line H to the power supply network. Connected in series in the main supply line H are a switching element AS (described below) and a power supply unit NT.

The power supply unit NT converts the network voltage of for example 230 V to a low voltage of 12 V. The low voltage 12V is converted by means of a regulator RG connected in series downstream of the power supply unit NT to a low voltage of 5 V, which is supplied to a control device SE. The power supply unit NT also supplies other appliance components and also the operating display BA of the household dishwasher with low voltage by way of additional outputs.

The control device SE is integrated in a control module (not shown in detail) and during the execution of a wash program actuates the visual display means AZ of the operating display BA and further appliance components, for example the drain pump or the circulating pump, by means of control signals $S_E$ by way of a first signal line SL1.

As also shown in FIG. 2, the control device SE is connected by way of a second signal line SL2 to a bistable relay RE of a self-holding contact circuit SKS. The abovementioned switching element AS, which is connected in the main supply line H instead of a mechanical main switch and as such takes on a main switch function, which can be used to decouple the household dishwasher from the power supply network or connect it to it, is assigned to the bistable relay RE as a relay contact. The control device SE of the household dishwasher is connected for signal transmission purposes SV to the visual display means EA of the extractor hood DUH with the transmission interface U connected in between, the visual display means EA also being assigned here as external display means to the domestic dishwasher. The signal connection SV between the transmission interface U of the household dishwasher and the external display means EA can be a radio connection by way of example here.

Also assigned to the control device SE is a door opening sensor TS, which can detect a closed or open state of the appliance door GT and forward it to the control device SE.

When the household dishwasher is out of operation both the microswitch ES and the switching element AS are open. The deactivated household dishwasher is brought into operation by actuation by pressing of the microswitch ES, causing the initially still open switching element AS to be bridged. The actuation by pressing of the microswitch ES causes a voltage pulse to be supplied, which is directed by way of the power supply unit NT and by way of the regulator RG to the control device SE.

The control device SE then forwards an activation signal $S_{on}$ to the bistable relay RE causing its relay coil to attract and the switching element AS to be switched from the power-free stable open state to an equally power-free stable closed state. This causes the microswitch ES, which after actuation by pressing is again open, to be bridged by the now closed switching element AS, with the result that the network voltage is present at the power supply unit NT.

The household dishwasher, and in particular its operating display BA, is therefore switched to operation readiness so that a wash program can then be started by means of the input means E. During the wash program and before the start of the wash program the visual display means AZ of the household dishwasher can display the operating state and set parameters. The external display means EA of the extractor hood DUH, which are specifically external in relation to the household dishwasher, can in contrast operate independently of the household dishwasher. At the end of the wash program the control device SE deactivates the appliance components, for example the drain pump or circulating pump.

Immediately after completion of the wash program the control device SE also generates a further voltage pulse, which as a deactivation signal $S_{off}$ by way of the second signal line SL2 actuates the bistable relay RE. The relay RE then switches the switching element AS from the closed position to the open position, with the result that the household dishwasher is completely isolated from the power supply network.

The visual display elements AZ of the household dishwasher are therefore also taken out of operation. The switching element AS of the relay RE therefore operates as a main switch which automatically isolates the power supply unit NT of the household dishwasher from the power supply network after the end of the wash cycle. This means that after the end of the program a supply of power by way of the power supply unit NT to the visual display means AZ of the operating display BA in particular is also interrupted.

As the deactivation signal $S_{off}$ is being generated, the control device SE also generates a program end signal $S_{end}$, which is directed by means of the transmission interface U to the display means EA of the extractor hood DUH. In this instance the display means EA for example displays the program end of the household dishwasher with a time limit, while the household dishwasher is already completely decoupled from the power supply network.

Additionally or as an alternative to such a time-limited program end display the control device SE, when it detects an opening actuation of the appliance door GT, can actuate the external display means EA with a trigger signal, to deactivate the program end display. To this end in a modification of the circuit arrangement in FIG. 2 the off switch AS for example is not disposed in the main supply line but between the power supply unit NT and the operating display BA of the household dishwasher. This allows the control device SE to actuate the external display means EA of the extractor hood DUH with the trigger signal at the end of the program, to bring about deactivation of the external display means EA.

As also shown in FIG. 2, the microswitch ES is connected directly to the control device SE for signal transmission purposes by way of an input line EL. The voltage pulse supplied when the microswitch ES is actuated manually by pressing is therefore also directed directly to the control device SE, which detects and analyzes the pulse.

On detection of such a voltage pulse the control device SE checks whether the power supply unit NT is already activated when the microswitch ES is activated by pressing. If the power supply unit NT is not yet activated, the control device SE identifies activation actuation by the user and uses the activation signal $S_{on}$, as described above, to actuate the relay RE. If the power supply unit NT is already activated, the control device SE identifies a deactivation actuation by the user from the actuation by pressing of the microswitch, so the control device SE directs a corresponding deactivation signal $S_{off}$ to the relay RE. The household dishwasher is then taken out of operation. Any ongoing wash program is therefore interrupted.

LIST OF REFERENCE CHARACTERS

ES Microswitch
AS Switching element
H Main supply line
B Control panel
AZ Display means BA Operating display
EL Input line
RG Regulator
SE Control device
RE Bistable relay
SKS Self-holding contact circuit
ST Controller
HG Household appliance
SL1, SL2 Signal lines
DUH Extractor hood
SV Signal connection
U Transmission interface
TS Door opening sensor
BR Treatment compartment
$S_{end}$ Program end signal

The invention claimed is:

1. A household appliance, comprising:

an external display;

a transmission interface connected for signal transmission to the external display;

a power supply network for supply of electrical energy; and an automatic switch that automatically isolates the appliance from the power supply network, wherein the transmission interface is configured to transmit a signal to activate the external display to display at least a completion of the treatment cycle, and the automatic switch automatically isolates the appliance after the display of the external display.

2. The household appliance of claim 1, constructed in the form of a household dishwasher.

3. The household appliance of claim 1, wherein the external display is activated by the signal close to a time of the completion of the treatment cycle.

4. The household appliance of claim 1, further comprising a controller configured for shutting down the household appliance after the completion of the treatment cycle.

5. The household appliance of claim 4, wherein the controller is configured to shut down the household appliance after activation of the external display.

6. The household appliance of claim 1, wherein the external display is deactivated during the treatment cycle or before it.

7. The household appliance of claim 1, further comprising an operating display configured to display an operating state of the household appliance and activated during the treatment cycle or before it.

8. The household appliance of claim 7, wherein the operating display is deactivated after the end of the treatment cycle.

9. The household appliance of claim 1, wherein the external display is configured to display the completion of the treatment cycle for a predefined time period.

10. The household appliance of claim 1, further comprising an appliance door, and a controller configured to generate a signal when detecting an opening of the appliance door.

* * * * *